US006044898A

United States Patent [19]

Pleschiutschnigg

[11] Patent Number: 6,044,898

[45] Date of Patent: Apr. 4, 2000

[54] CONTINUOUS-CASTING MOLD AND A PROCESS FOR THE CONTINUOUS CASTING OF THIN SLABS OF METAL

[75] Inventor: Fitz-Peter Pleschiutschnigg, Duisburg, Germany

[73] Assignee: Mannesmann AG, Düsseldorf, Germany

[21] Appl. No.: 09/101,261

[22] PCT Filed: Dec. 3, 1996

[86] PCT No.: PCT/DE96/02375

§ 371 Date: Aug. 18, 1998

§ 102(e) Date: Aug. 18, 1998

[87] PCT Pub. No.: WO97/24196

PCT Pub. Date: Jul. 10, 1997

[30] Foreign Application Priority Data

Dec. 27, 1995 [DE] Germany ..... 195 49 275

[51] Int. Cl.[7] ..... B22D 11/10; B22D 11/124

[52] U.S. Cl. ..... 164/485; 164/437; 164/443; 164/488

[58] Field of Search ..... 164/418, 459, 164/485, 443, 488, 437

[56] References Cited

U.S. PATENT DOCUMENTS 5,941,298 8/1999 Pleschiutschnigg ..... 164/418

*Primary Examiner*—Kuang Y. Lin

*Attorney, Agent, or Firm*—Cohen, Pontani, Lieberman & Pavane

[57] ABSTRACT

The invention relates to a process and a continuous-casting mold for casting thin slabs. The mold has an oblong inner cross-sectional area and cooled mold walls. The melt is poured in through at least one delivery nozzle which dips into the melt. To ensure that, during casting, markedly lower stresses and, as a consequence thereof, fewer cracks appear in the strand shell, at least at the casting level being established and at least over a part of the depth of immersion of the delivery nozzle, the ratio of the gap widths $S_{TI}$ and $S_{II/2}$ and the ratio of the cooling capacities $L_{TI}$ and $L_{II}$ of the mold wall are related by the equation:

$$[S_{TI}/(S_{II}/2)]/[L_{TI}/L_{II}]>1.$$

$S_{TI}$ is the width of the gap formed in the zone immediately surrounding the particular immersed delivery nozzle by the outer surface of the delivery nozzle and by the inner surface of the directly opposite mold wall, and $S_{II/2}$ is half the width of the gap formed by the inner surfaces in the zones in which the inner surfaces of the mold walls are directly opposite each other. $L_{TI}$ and $L_{II}$ are the cooling capacities of the zones of the mold wall which form the respective gap or gap section.

16 Claims, 2 Drawing Sheets

CONTINUOUS-CASTING MOLD AND A PROCESS FOR THE CONTINUOUS CASTING OF THIN SLABS OF METAL

BACKGROUND OF THE INVENTION

1. Field of the Invention

The invention relates to a continuous-casting mold for casting thin slabs, the mold having an oblong inner cross-sectional area and cooled mold walls. The melt is poured in through at least one delivery nozzle which dips into the melt. The invention further relates to a process for continuously casting thin slabs.

2. Discussion of the Prior Art

In the continuous casting of strands having an oblong cross section, it is known to form the inner cross-sectional area of the continuous-casting mold so that a strand section as close as possible to the desired final dimensions is produced by the continuous-casting mold. In this case, especially those section beams having an H-shaped cross section and also those having a cross section in which the cross-sectional ends have thickenings (dog bone-shaped cross section), the problem regularly arises that the ends, which are widened and/or thickened relative to the web width, of the section beam frequently show cracks and stresses and/or undesired crystal structures are cast close to the final dimensions. In the case of section strands not cast close to the final dimensions, however, technically involved and cost-intensive rolling processes are required after casting in order to obtain the desired final dimensions.

DE 2,034,762 A1 has disclosed a process and apparatus for producing a thin strip, in which the strip has a thickening which extends in its longitudinal direction and which still has a liquid core. This thickening is then forced back underneath the mold by pressure rollers.

U.S. Pat. No. 5,082,746 discloses specially dimensioned section strands which must not exceed predetermined cross-sectional parameters arid which have a predetermined homogeneous crystal structure, so that the desired cross-sectional profile can then be obtained with the minimum of rolling work. Such section strands can, as experience shows, be cast using one or more delivery nozzles for pouring in the melt. In this case, it has been found that merely the restriction of the cross-sectional parameters and the setting of a desired crystal structure are not sufficient to produce section strands close to the final dimensions without cracks, and with a homogeneous crystal structure over the entire cross section. It is also insufficient, in the case of a strand section with flanks molded onto the ends, to select the web width to be equal to the flank width, as is explicitly suggested in U.S. Pat. No. 5,082,746. In fact, section strands produced specifically under these conditions regularly show cracks and, particularly in the zone of the flanks, a less favorable crystal structure than that of the web, which indicates that uniform casting conditions in each cross-sectional zone during casting with the use of immersed delivery nozzles cannot simply be achieved by adhering to limiting values of the above-mentioned cross-sectional parameters.

SUMMARY OF THE INVENTION

It is the object of the present invention to provide a process and a continuous-casting mold having cooled mold walls for casting strands having an oblong inner cross-sectional area, for example section strands having an H-shaped cross section and a predetermined web width, the melt being poured in by at least one delivery nozzle which dips into the melt, in which mold markedly lower stresses arise during casting and, as a consequence thereof, fewer cracks appear in the strand shell. Furthermore, the cast strands should have a homogeneous crystal structure over the entire cross section.

The invention provides that, at least at the casting level being established at least over a part of the depth of immersion of the delivery nozzle, the ratio of the gap widths $S_{TI}$, in the zone immediately surrounding the delivery nozzle, and $S_{II}/2$, in the zones in which the inner surfaces of the mold walls are directly opposite one another, and the ratio of the cooling capacities $L_{TI}$ and $L_{II}$ of the corresponding zones of the mold wall (1, 2) are related by the equation:

$$[S_{TI}/S_{II}/2)]/[L_{TI}/L_{II}]>1.$$

$S_{TI}$ here is the width of the gap formed by the outer surface of the particular delivery nozzle and by the inner surface of the directly opposite mold wall. $S_{II}/2$ is half the width of the gap formed by the inner surfaces and, in particular in the zones in which the inner surfaces of the mold walls are directly opposite each another, i.e. in which no delivery nozzle is located between the inner surfaces. $L_{TI}$ and $L_{II}$ are the cooling capacities of the mold wall in the corresponding zones.

The continuous-casting mold having an internal cross section dimensioned in this way makes it possible to uniformly melt casting flux resting on the casting level even at high casting speeds and to take it off uniformly together with the slag. This leads to the formation of a molten slag/casting flux layer of uniform height over the entire inner cross-sectional area. A slag/casting flux layer of uniform height advantageously effects, during continuous casting, the formation of a uniform slag/casting flux layer between the mold wall and the strand surface. In this way, very good sliding of the strand shell along the entire mold wall can be ensured and the heat of the melt or of the strand can be removed very uniformly through the mold walls during casting, so that a strand shell having a very homogeneous crystal structure and no stresses and cracks is formed.

Advantageously, $[S_{TI}/(S_{II}/2)]/[L_{TI}/L_{II}]$ is between 1.05 and 1.30 over the entire depth of immersion of the delivery nozzle and, hereby in particular the influence of the wall of the delivery nozzle upon the thermal conditions in the mold during casting is taken into account.

With the uniform cooling of the mold walls, the dimensioning of the required internal cross section of the continuous-casting mold can be simplified so that $[S_{TI}/(S_{II}/2)]>1$ applies, and preferably $[S_{TI}/(S_{II}/2)]$ is between 1.05 and 1.30, whereby, in particular, the influence of the wall of the delivery nozzle upon the thermal conditions in the mold during casting is again taken into account.

If the delivery nozzle is located in the web zone, pursuant to the invention the delivery nozzle has an oblong cross section. As a result, the zones of the long sides opposite the delivery nozzle have to be shaped outward only to a relatively small extent.

The invention also proposes, in particular for producing a cross section having thickened ends (dog bone shaped), to locate two delivery nozzles in the zone of each of the short sides. In this case, it is of advantage, with regard to the final dimensions, if the delivery nozzles then have, for example, a substantially triangular cross section.

For cooling the mold walls, cooling elements are used, for example cooling tubes, which are distributed over the mold walls per unit area in such a way that the cooling capacity intended in the corresponding zone is achieved.

BRIEF DESCRIPTION OF THE DRAWINGS

An illustrative embodiment of the invention is shown in the drawing and is described in more detail below, where.

DETAILED DESCRIPTION OF THE PREFERRED EMBODIMENTS

Figure 1:
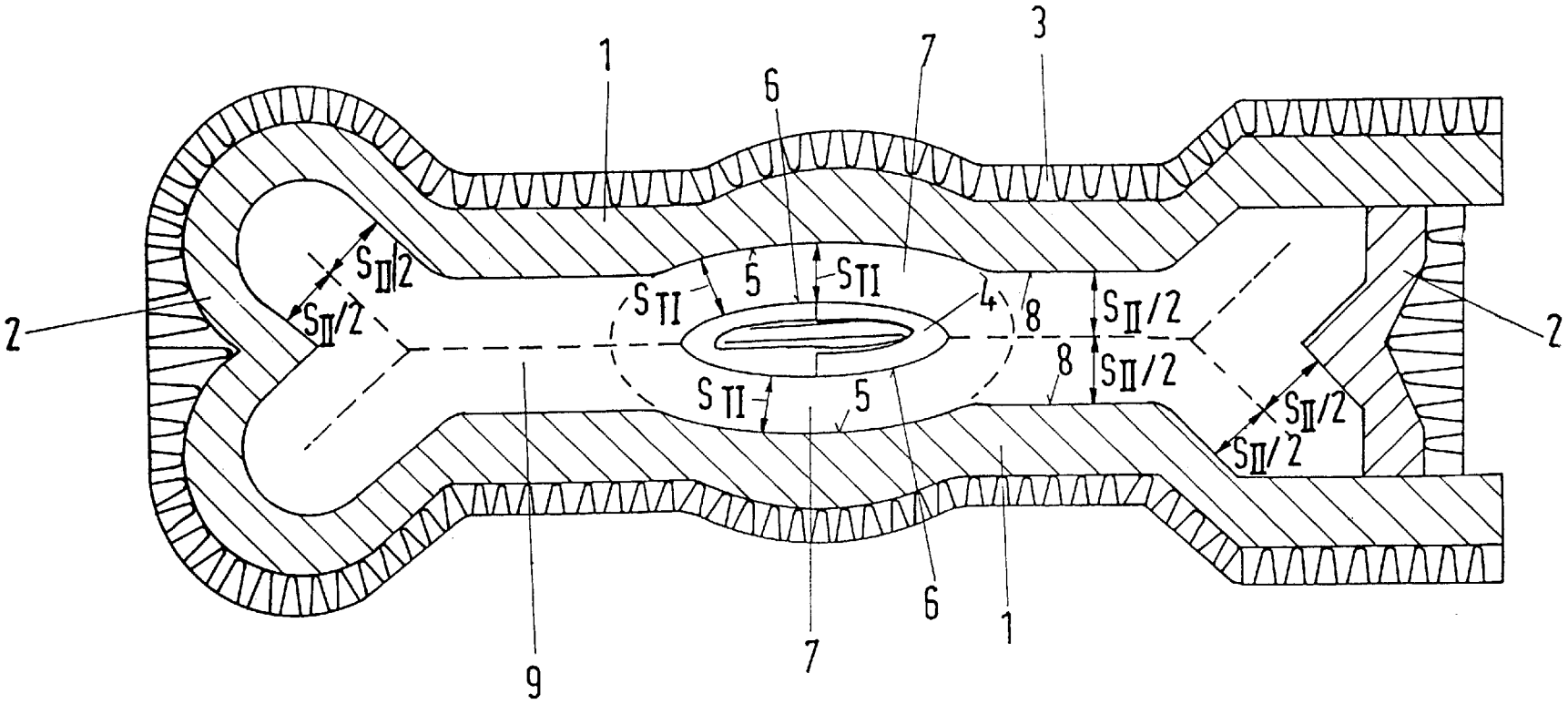
FIG. 1 shows a cross section of a continuous-casting mold when operated with a central delivery nozzle.

FIG. 1 shows a cross section through a continuous-casting mold having an oblong inner cross-sectional area at the casting level established for casting strands. The long-side mold walls 1, 1 and the short-side mold walls 2, 2 are each arranged mutually opposite to form a casting chamber. The walls 1, 2 preferably consist of copper and are provided with cooling tubes 3 for removing heat. The cooling tubes 3 here ensure uniform heat removal via the mold walls 1, 2, since an appropriate number of cooling tubes 3 in the mold wall 1, 2 is provided per unit area. With the mold shown in FIG. 1 in operation, a delivery nozzle 4, which dips into the melt and preferably has an oblong cross section, is centrally arranged for pouring in the melt.

FIG. 1 shows that, in the immediate surroundings of the delivery nozzle 4, the long-side mold walls 1, 1 are each curved outward, namely in such a way that the gap 7, formed between the long-side mold walls 1, 1 and the delivery nozzle 4, has a substantially constant gap width STI over the entire depth of immersion of the nozzle 4. This is achieved in the illustrated embodiment shown in FIG. 1 in such a way that the outer surfaces 6 of the delivery nozzle 4 have a contour similar to that of the immediately opposite inner surfaces 5 of the long-side mold walls 1. Due to the oblong shape of the delivery nozzle 4, the zones of the long sides 1 opposite the delivery nozzle 4 have to be outwardly shaped to a relatively small extent.

In the remaining zones to the left and to the right of the delivery nozzle 4, the directly opposite inner surfaces 8 of the long-side mold walls 1, i.e. without the delivery nozzle located in between, form a gap 9, one half of whose gap width $S_{II}/2$ is at most equal to $S_{TI}$, i.e. the gap width of the directly opposite inner surfaces 8 is at most twice the gap width $S_{TI}$ of the gap 7.

Figure 2:
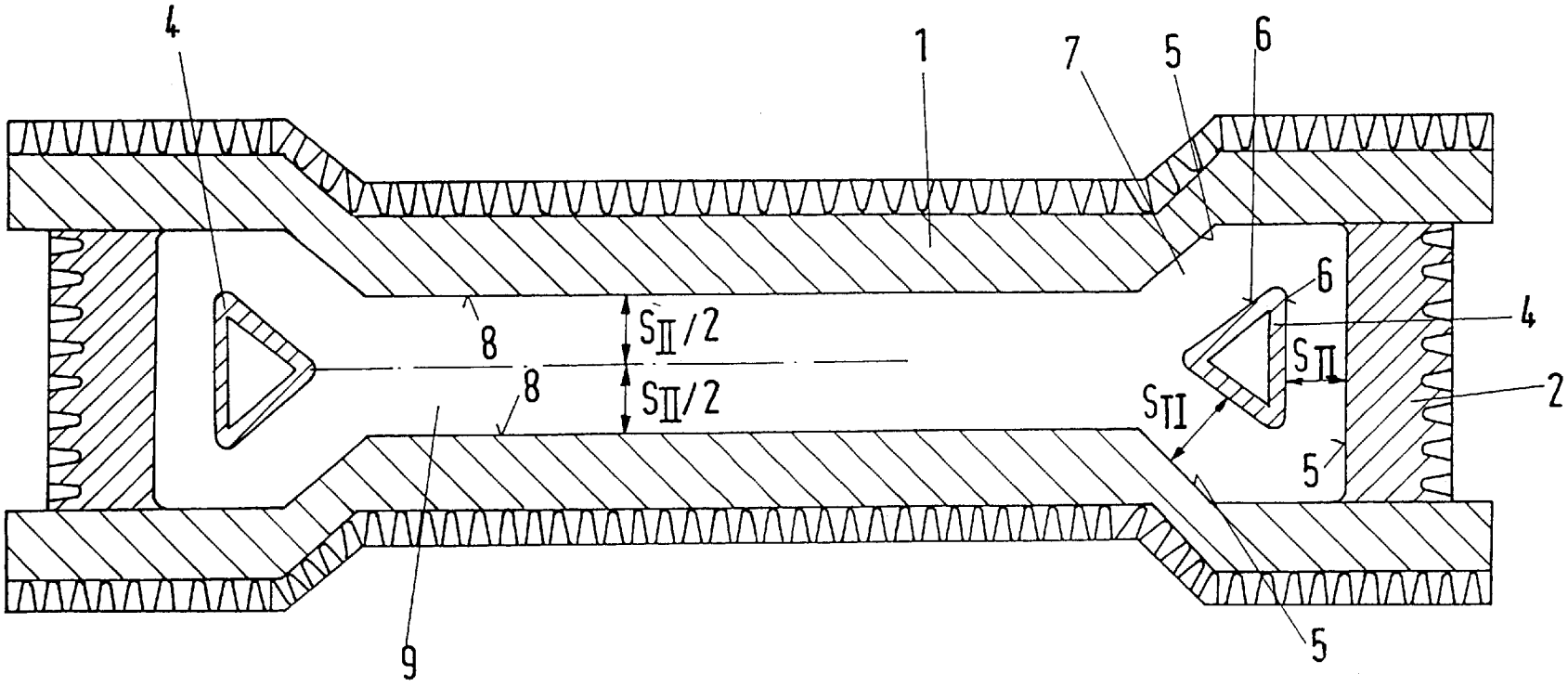
FIG. 2 shows a cross section of a continuous-casting mold when operated with two delivery nozzles arranged on the short sides and each having a triangular cross section.

A further embodiment of a continuous-casting mold having an inner cross-sectional area dimensioned according to the invention is shown in FIG. 2. The continuous-casting mold shown in FIG. 2 has, in the zone of the short-side mold walls 2, an enlargement of the mold interior, in each of which a delivery nozzle 4 is located (cross section with thickened ends, also known as dog bone cross section). The outer cross section of the delivery nozzle 4 can be of almost any desired shape; in the illustrative embodiment according to FIG. 2, the delivery nozzle 4 is of substantially triangular outer cross section. In the zone of the delivery nozzle 4, the gap 7 formed by the outer surface 6 of the delivery nozzle 4 and the directly opposite inner surface 5 of the mold wall is again dimensioned over the entire depth of immersion so that the gap width $S_{TI}$ is substantially constant.

In the middle zone of the continuous-casting mold, where the inner surfaces 8 of the mold long-side walls 1 are directly opposite, forming the gap 9, half the width $S_{II}/2$ of the gap 9 is somewhat less than $S_{TI}$; the gap 9 itself is thus again at most twice the width $S_{TI}$ of the gap 7 in the zone of the section ends.

A substantially constant gap width in the illustrated embodiments means that, in relatively small zones, i.e. for example in the corners of the triangular cross section of the delivery nozzle 4, variations from the demanded uniformity of the gap width can arise. Consequently, the uniformity of the gap width must only be approximately met in these zones, but it should not exceed twice the value. In the same way, the flanks—as can be seen in the left-hand half of FIG. 1—can be shaped somewhat outward. of course, the gap width in both illustrative embodiments can be reduced or enlarged if, in the zone of the gap 7, the cooling capacity of the mold long-side wall 1 is, respectively, smaller cr greater in the corresponding zones. The decisive point is that the ratio of gap width ($S_{TI}$ or $S_{II}/2$) and cooling capacity ($L_{TI}$ and $L_{II}$ respectively) of the corresponding zone of the mold wall 1 is constant at each point of the continuous-casting mold and is preferably within the range between 1.05 and 1.30. In the illustrative embodiments, this value is 1.05.

During operation of the continuous-casting mold according to FIG. 1 or FIG. 2, the mold is continuously filled with molten steel via the delivery nozzle or nozzles 4, and the cast section strand is taken off at constant speed. During the casting with constant take-off speed, exactly the same quantity of molten steel is continuously poured in as that taken off at the mold outlet, so that the casting level being established is constant with continuous renewal of the molten steel remaining in this zone, and this additionally effects the melting of the casting flux introduced and lying on the casting level. The essentially constant gap width in the illustrative embodiments according to FIG. 1 and FIG. 2 then ensures a uniform upward-directed heat flux in all cross-sectional zones of the continuous-casting mold, so that, in the zone of the casting level, uniform melting of the casting flux takes place, i.e. the same quantity of casting flux is always melted per unit surface area of the casting level in per unit time. In addition, at a constant take-off speed of the cast section strand, the slag/casting flux layer being formed establishes itself at the same height at each point of the inner cross-sectional area in the casting level zone as a result of the inner cross-sectional shape according to the invention. Connected thereto is a slag/casting flux film, likewise being automatically established, of constant thickness between the mold wall 1,2 and the melt or strand shell at all points of the strand surface.

Due to the specific dimensioning of the mold and the slag/casting flux film of constant thickness, thereby being established during casting, a quantity of heat proportional to the wall area is continuously removed from the molten steel in the zone of the mold walls and the melt is uniformly cooled to form the strand shell. The quantitative influence of the slag/casting flux film results directly from the specific thermal conductivity thereof and the thickness of the film being established. A constant thickness of the mold wall 1,2 effects, at a given temperature difference, a constant thermal resistance during the removal of the quantity of heat from the melt through the mold walls 1,2. The total thermal resistance results from the sum of the individual partial thermal resistances, into which the reciprocals of each of the specific thermal conductivities of the layers (mold wall—slag/casting flux—strand shell melt—wall of the delivery nozzle) located one behind the other enter. The specific thermal conductivity of the slag/casting flux film is about 1 W/Km and is thus determining for the heat removal and hence for the cooling of the strand, as has been shown by experimental investigations. By means of the invention, the heat transition into the mold is made uniform over the entire mold length in the horizontal direction via the constant thickness of the slag/casting flux film being established. Temperature differences in the strand shell/mold wall boundary zone are greatly reduced in this way, so that only slight stresses are then still present in the strand shell of the cast strand, which greatly reduces the danger of cracks forming. In addition, as a result of the very good uniform lubrication thus obtained, the walls of the continuous-casting mold are exposed to reduced wear, so that additionally their service life is markedly extended.

I claim:

1. A continuous-casting mold for casting thin slabs, comprising:

cooled mold walls that define an oblong inner cross-sectional area; and a delivery nozzle which pours melt into the mold and which dips into the melt, the mold walls being configured so that, at least at a casting level established at least over a part of a depth of immersion of the delivery nozzle into the melt, a ratio of gap widths ($S_{TI}$ and $S_{II}/2$) and a ratio of cooling capacities ($L_{TI}$ and $L_{II}$) of the mold wall are related by the equation:

$$[S_{TI}/(S_{II}/2)]/[L_{TI}/L_{II}]>1,$$

where $S_{TI}$ is the width of a gap formed in a zone immediately surrounding the delivery nozzle by an outer surface of the delivery nozzle and by an inner surface of the mold wall, and $S_{II}/2$ is half a width of a gap formed by inner surfaces of the mold walls in zones in which the inner surface of the mold walls are directly opposite each other, and $L_{TI}$ and $L_{II}$ are the cooling capacities of the zones of the mold wall which form the respective gaps.

2. A continuous-casting mold as defined in claim 1, wherein the ratio of the gap widths $S_{TI}$ and $S_{II}/2$ and the ratio of the cooling capacities $L_{TI}$ and $L_{II}$ of the corresponding zones of the mold wall are related by the equation:

$$[S_{TI}/(S_{II}/2)]/[L_{TI}/L_{II}]=1.05–1.30.$$

3. A continuous-casting mold as defined in claim 1, wherein the mold walls are configured to have a uniform cooling capacity, the ratio of the gap widths $S_{TI}$ and $S_{II}/2$ being $$[S_{TI}/(S_{II}/2)]>1.$$

4. A continuous-casting mold as defined in claim 1, wherein the mold walls are configured to have a uniform cooling capacity, the ratio of the gap widths $S_{TI}$ and $S_{II}/2$ being $$[S_{TI}/(S_{II}/2)]=1.05–1.30.$$

5. A continuous-casting mold as defined in claim 1, wherein the delivery nozzle has an oblong cross section.

6. A continuous-casting mold as defined in claim 1, wherein the delivery nozzle has a substantially triangular cross section.

7. A continuous-casting mold as defined in claim 6, wherein the mold walls include short side walls and long sidle walls that extend between the short side walls, a separate delivery nozzle being located in a region of each of the short side walls.

8. A continuous-casting mold as defined in claim 1, and further comprising cooling elements arranged at the mold walls so as to have a distribution that matches a desired cooling capacity.

9. A process for continuous casting of thin slabs having an oblong inner cross-sectional area, comprising the steps of:

providing a mold having cooled walls; and pouring melt into the mold via at least one delivery nozzle that dips into the melt, wherein, at least at a casting level being established at least over a part of a depth of immersion of the delivery nozzle into the melt, a ratio of gap widths ($S_{TI}$ and $S_{II}/2$) and a ratio of cooling capacities ($L_{TI}$ and $L_{II}$) of the mold walls are related by the equation:

$$[S_{TI}/(S_{II}/2)]/[L_{TI}/L_{II}]>1,$$

where $S_{TI}$ is the width of a gap formed in a zone immediately surrounding the delivery nozzle by an outer surface of the delivery nozzle and by an inner surface of the mold wall, and $S_{II}/2$ is half a width of a gap formed by the inner surfaces of the mold walls in zones in which the inner surfaces of the mold walls are directly opposite each other, and $L_{TI}$ and $L_{II}$ are the cooling capacities of the zones of the mold walls which form the respective gaps.

10. A process as defined in claim 9, wherein, for the entire depth of immersion of the delivery nozzle, the ratio of the gap widths $S_{TI}$ and $S_{II}/2$ and the ratio of the cooling capacities $L_{TI}$ and $L_{II}$ of the corresponding zones of the mold walls are related by the equation:

$$[S_{TI}/(S_{II}/2)]/[L_{TI}/L_{II}]=1.05–1.30.$$

11. A process as defined in claim 9, wherein the mold walls have a uniform cooling capacity and the ratio of the gap widths $S_{TI}$ and $S_{II}/2$ is $$[S_{TI}/(S_{II}/2)]>1.$$

12. A process as defined in claim 9, wherein the mold walls have uniform cooling capacity, the ratio of the gap widths $S_{TI}$ and $S_{II}/2$ is $$[S_{TI}/(S_{II}/2)]=1.05–1.30.$$

13. A process as defined in claim 9, wherein the delivery nozzle has an oblong cross section.

14. A process as defined in claim 9, wherein the delivery nozzle has a substantially triangular cross section.

15. A process as defined in claim 14, wherein the mold walls include short side walls and long side walls that extend between the short side walls, the pouring step including pouring melt into the mold with a separate delivery nozzle located in a region of each of the short side walls.

16. A process as defined in claim 9, including cooling the mold walls with cooling elements having a distribution that matches a desired cooling capacity.

* * * * *